US006929507B2

(12) United States Patent
Lin

(10) Patent No.: US 6,929,507 B2
(45) Date of Patent: Aug. 16, 2005

(54) COAXIAL CONNECTOR STRUCTURE

(75) Inventor: Kuotung Lin, Qiao Tou Hsiang (TW)

(73) Assignee: Huang Liang Precision Enterprise Co., Ltd., Kaohsiung (TW)

( * ) Notice: Subject to any disclaimer, the term of this patent is extended or adjusted under 35 U.S.C. 154(b) by 18 days.

(21) Appl. No.: 10/747,365

(22) Filed: Dec. 30, 2003

(65) Prior Publication Data

US 2005/0142937 A1 Jun. 30, 2005

(51) Int. Cl.[7] ..... H01R 17/04
(52) U.S. Cl. ..... 439/578; 439/874
(58) Field of Search ..... 439/578, 579–585, 439/675, 874; 174/78

(56) References Cited

U.S. PATENT DOCUMENTS 4,615,115 A * 10/1986 Bosshard et al. ..... 29/860
4,688,876 A * 8/1987 Morelli ..... 439/578
5,177,806 A * 1/1993 Abbott et al. ..... 385/76
5,195,910 A * 3/1993 Enomoto et al. ..... 439/578
5,828,555 A * 10/1998 Itoh ..... 361/784

* cited by examiner

*Primary Examiner*—Tho D. Ta
*Assistant Examiner*—James R. Harvey
(74) *Attorney, Agent, or Firm*—Rosenberg, Klein & Lee

(57) ABSTRACT

A coaxial connector structure includes a connector and a signal wire. The connector has a threaded section at one end and a connecting section at the opposite end. The connecting section has an enlarged section with a metal sleeve therein. The sleeve is formed with a connecting end at one end and a pair of through holes across the sleeve. The through holes are filled with solder to secure and connect the signal wire with a metal layer to reinforce the strength of the connection between the signal wire and the metal layer.

1 Claim, 5 Drawing Sheets

COAXIAL CONNECTOR STRUCTURE

FIELD OF THE INVENTION

This invention relates to a coaxial connector structure, and more particularly to one using solder to enhance the connection strength and mass production.

BACKGROUND OF THE INVENTION

Due to the technology, many products, such as computer, notebook, PDA or many other electric products utilize a coaxial wire to transmit a signal in a fast speed. The coaxial wire requires a coaxial connector to connect products. A conventional one, as shown in FIGS. 4 and 5, comprises a connector A and a signal wire B. The connector A has a threaded section A1 and a connecting section A2 at the other end for the signal wire B to insert therein. There is a washer A3 between the threaded section A1 and the connecting section A2 as an insulator. The connecting section A2 further comprises a sleeve A4 therein. The signal wire B comprises a core B1 to transmit a signal (either a positive or negative pole). The core B1 is enwrapped with an insulating layer B2 which then is enwrapped with a metal layer B3. The metal layer B3 transmits a signal in a pole opposing the signal wire B1. The metal layer B3 is enwrapped with a nonconducting cover B4.

To assemble, cut a portion from one end of the cover B4 off to expose the metal layer B3, peer the metal layer B3 away and bend reward over the cover B4, then insert the signal wire B into the sleeve A4 of the connector A through the connecting section A2 and clamp the connecting section A2 to secure the signal wire B to the sleeve A4. Whereas the sleeve A4 and the metal layer B3 is in contact with the connecting section A2, thus, the signal is transmitted through the core B1 and the metal layer B3, simultaneously.

However, the connection between the connecting section A2 and the signal wire B is not strong enough that can easily be detached by force, and the peering away of the metal layer B3 has to be done manually, which consumes time and labor.

Further, the U.S. Pat. No. 4,615,115 disclosed a coaxial connector, which comprises a number of metal layers and insulating layers to wrap with each other and then soldering to a fixed place. Other than this, the product also uses threads 3*a* to secure a sleeve 2 to the inner wall of the connector 14. This design is complicated and requires more labor hours, and the connecting area is weak and may easily be loosened, which affects the quality of signal transmission and receiving.

SUMMARY OF THE INVENTION

It is the primary object of the present invention to provide a coaxial connector structure, which design is simple and can be produced in automation.

It is another object of the present invention to provide a coaxial connector structure, which is more reliable.

It is a further object of the present invention to provide a coaxial connector structure, which provides a better connection signal.

It is still a further object of the present invention to provide a coaxial connector structure, which saves labor hours and is cost effectiveness.

DETAILED DESCRIPTION OF THE PREFERRED EMBODIMENT

Figure 1:
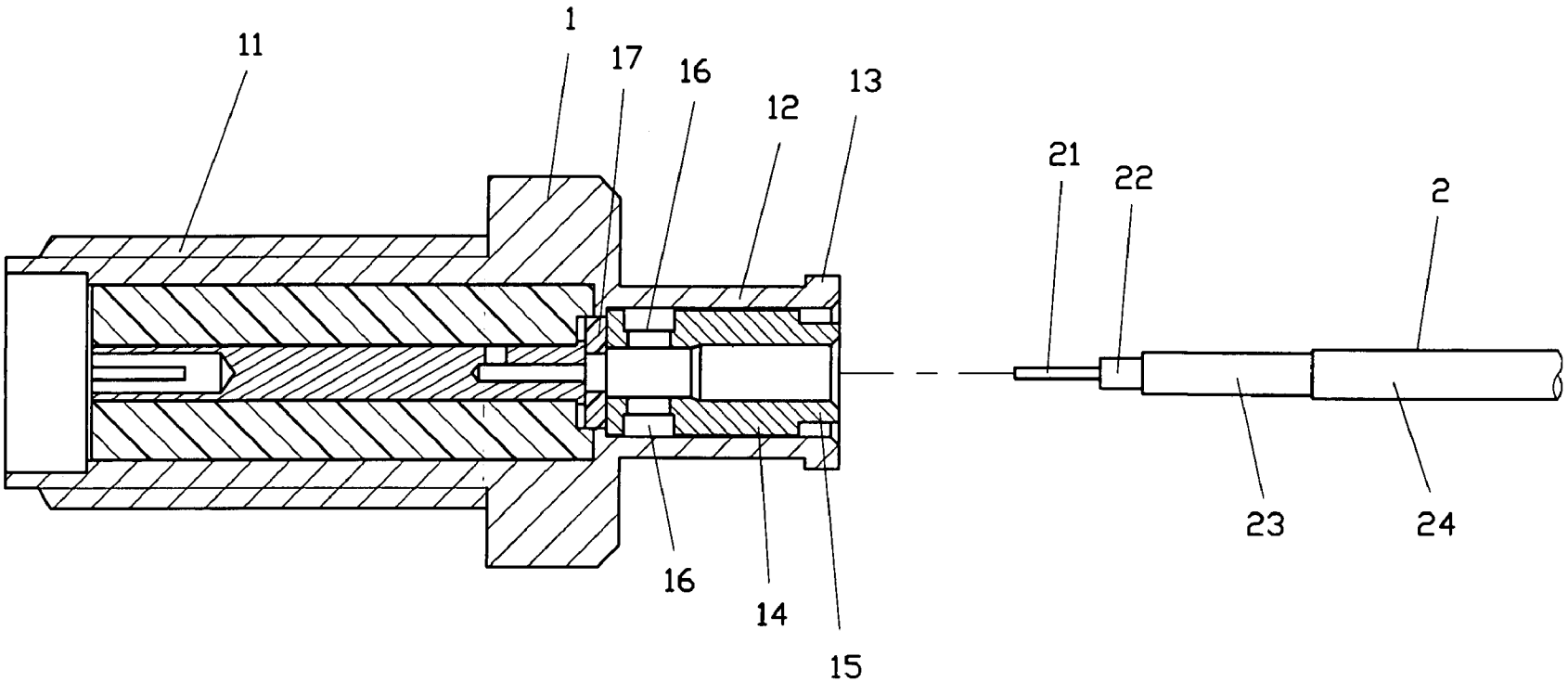
FIG. 1 is an exploded view of the present invention, partially sectioned.
Figure 2:
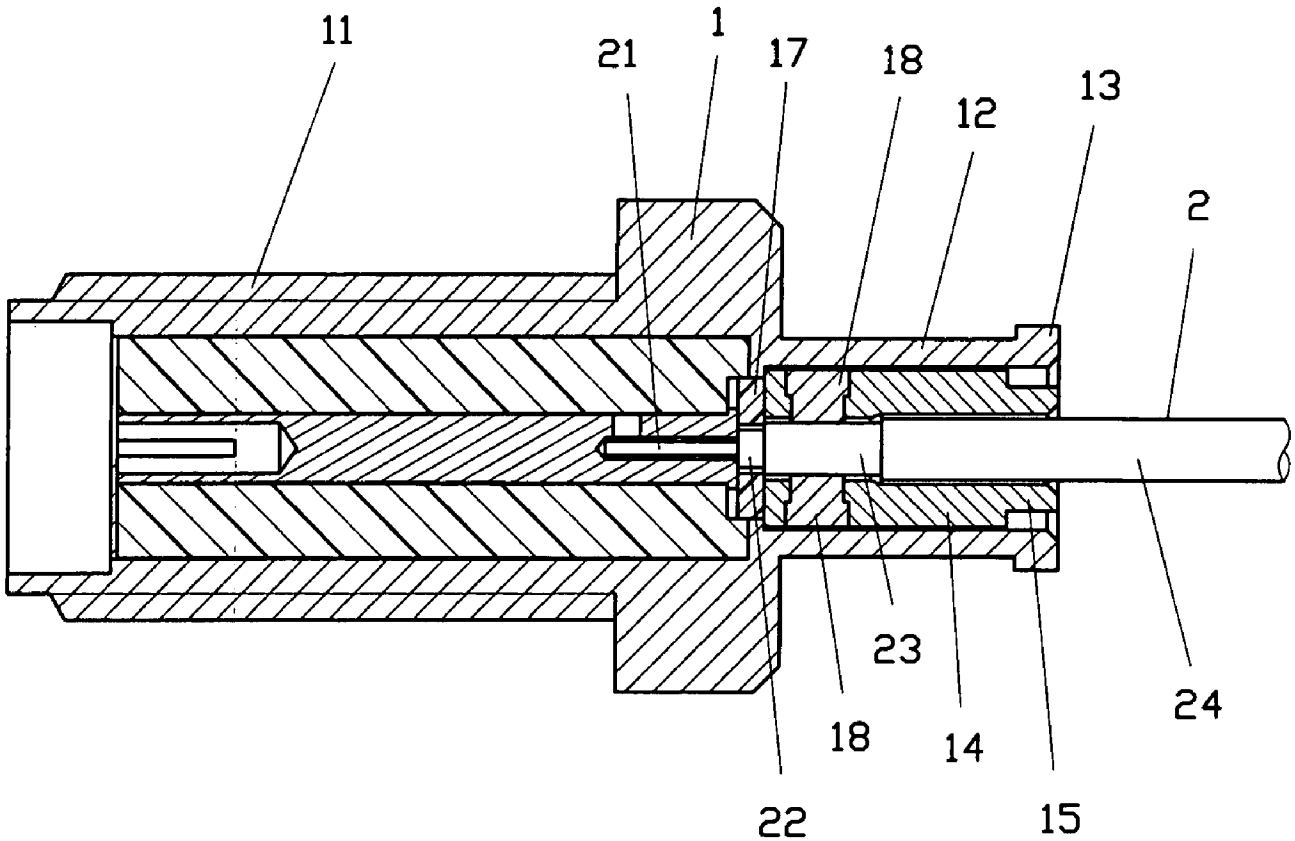
FIG. 2 is a side sectional view showing that solder is filled into through holes of the connector of the present invention.

As shown in FIGS. 1 and 2, the present invention comprises a connector 1 and a signal wire 2.

The connector 1 is made of metal with one end formed with a threaded section 11 and a hollow connecting section 12 at the opposite end thereof. The connecting section 12 has an enlarged section 13 with a metal sleeve 14 therein. The sleeve 14 is formed with a connecting end 15 at one end and a pair of through holes 16 across the sleeve 14. There is a washer 17 located between the threaded section 11 and the connecting section 12 as an insulating device.

The signal wire 2 is secured in the connecting section 12 of the connector 1, with a metal core 21 to conduct an electrical pole (either positive or negative pole). The metal core 21 is enwrapped with an insulating layer 22. The insulating layer 22 is enwrapped with a metal layer 23. The metal layer 23 is then protected with a nonconducting cover 24. The metal layer 23 is to conduct another electrical pole (either positive or negative pole).

Figure 3:
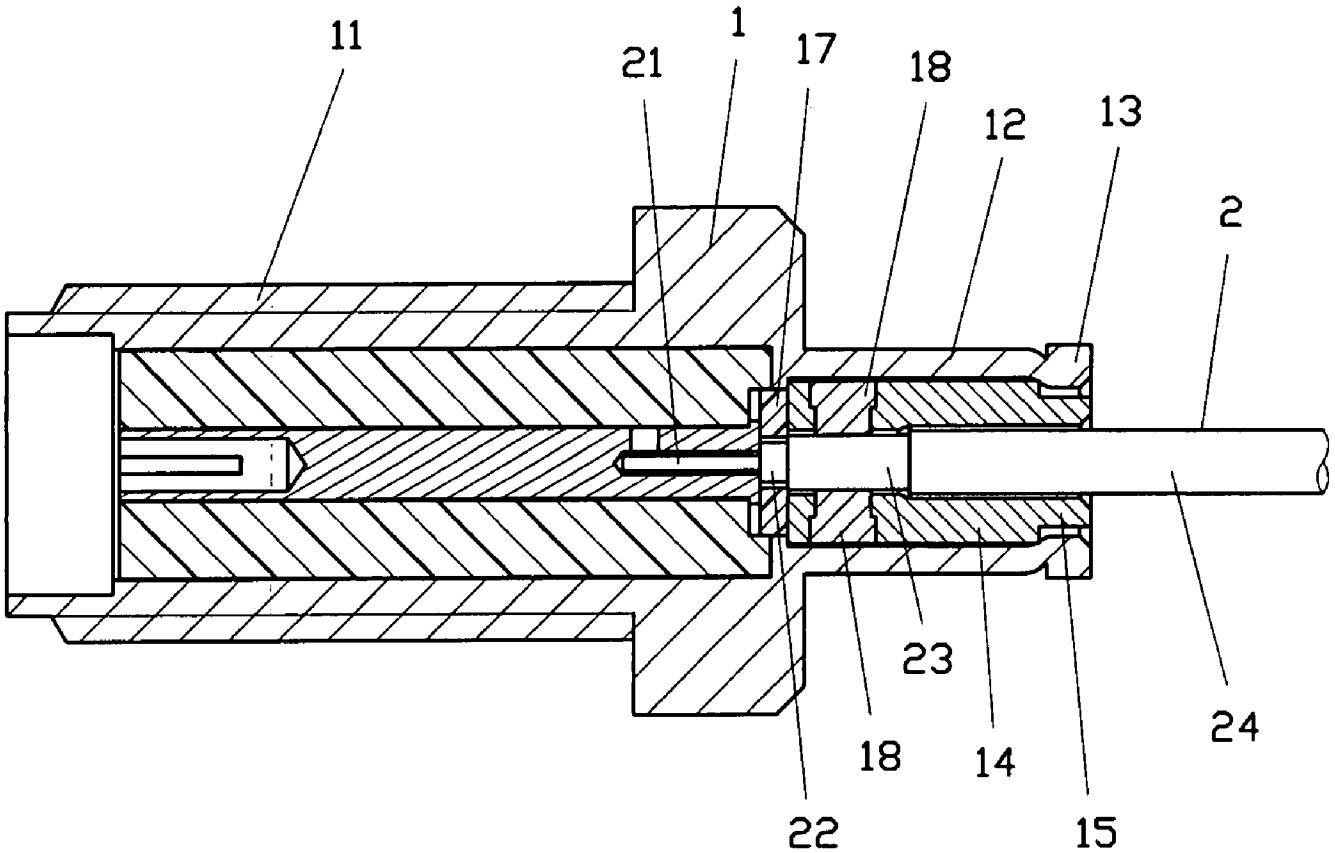
FIG. 3 is a view showing an assembled connector.
Figure 4:
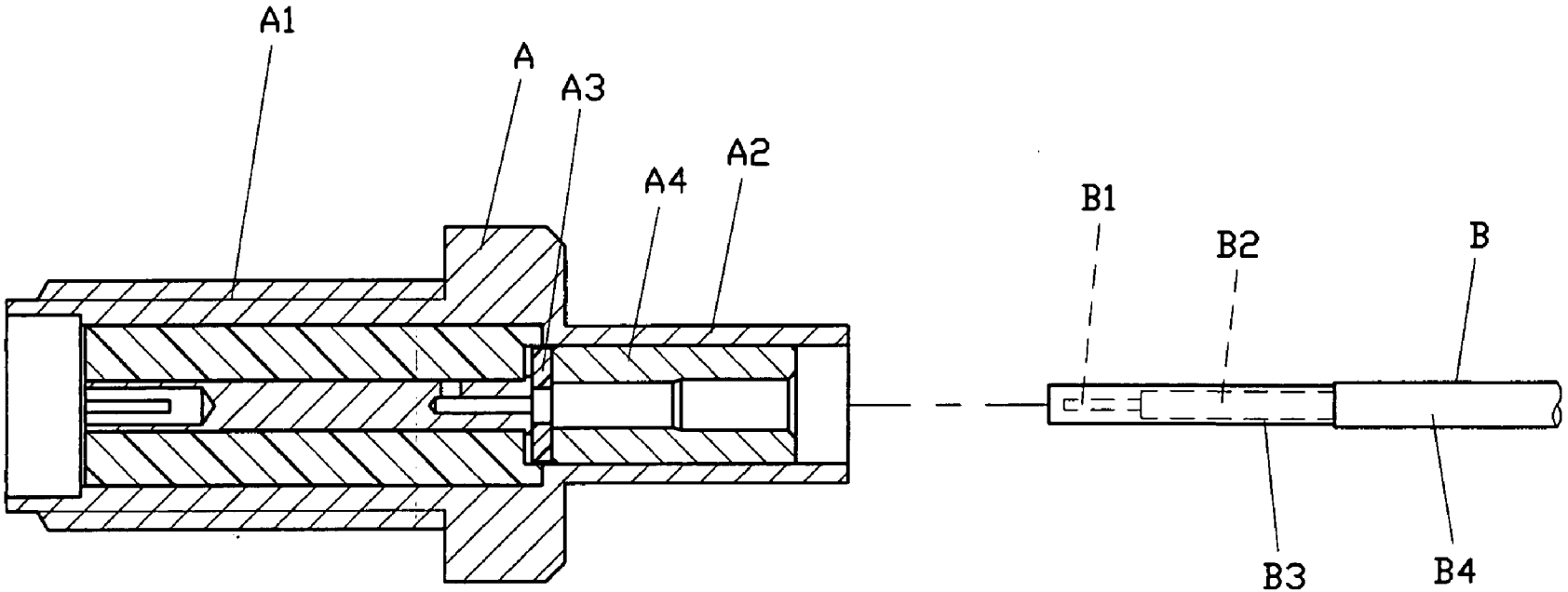
FIG. 4 (PRIOR ART)
FIG. 4 is an exploded view of a prior art.
Figure 5:
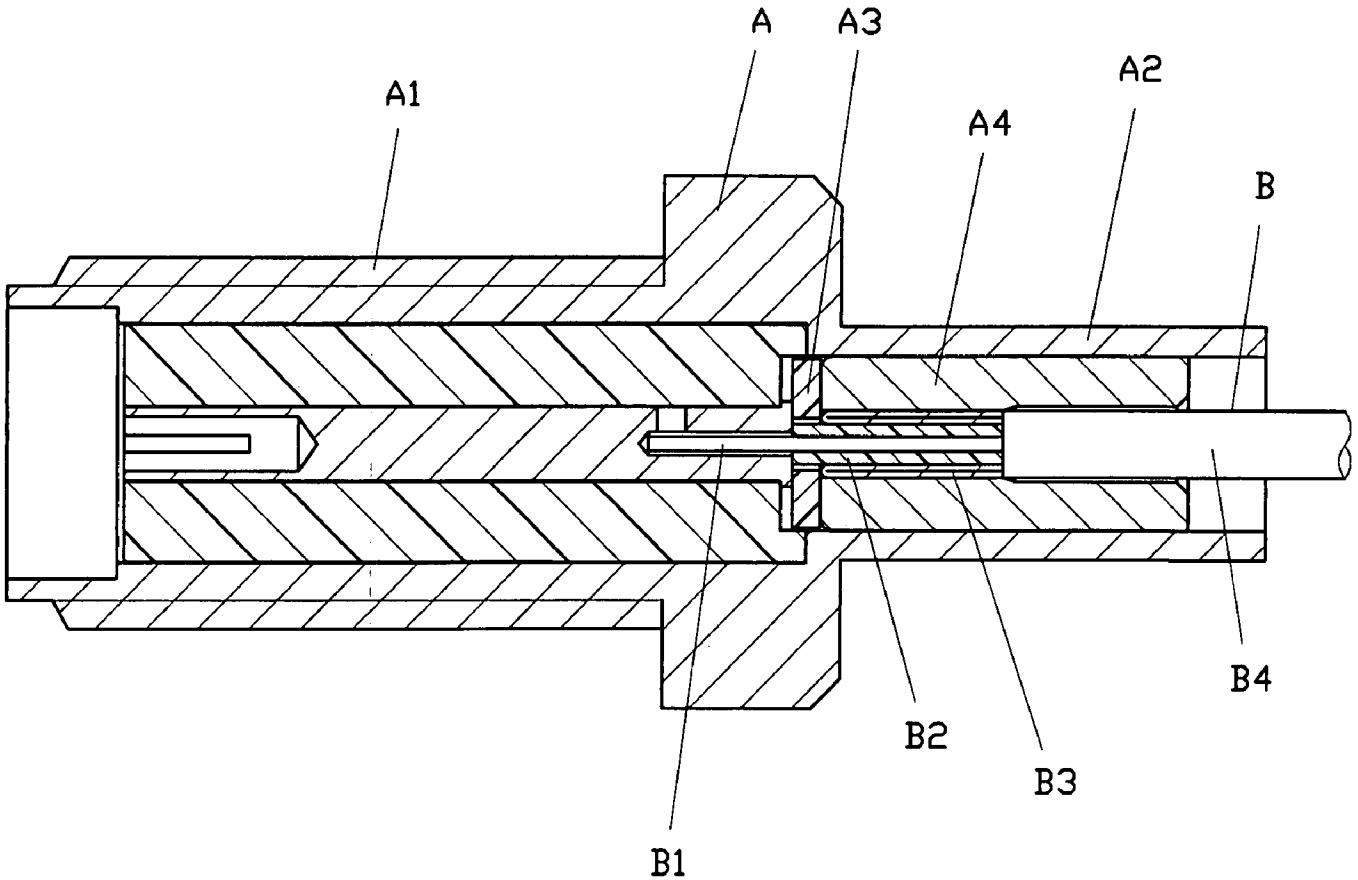
FIG. 5 (PRIOR ART)
FIG. 5 is a view showing an assembled connector of FIG. 4.

To assemble the present invention, as shown in FIG. 2, the signal wire 2 is inserted into the sleeve 14 and filled with solder 18 into the two through holes 16. The solder will dissolve and secure with the metal layer 23. The sleeve 14 is then inserted into the connecting section 12 of the connector 1 and pressed to secure, as shown in FIG. 3. There is a gap between the enlarged section 13 of the connecting section 12 and the connecting end 15 of the sleeve 14. The pressing procedure pushes the wall of the enlarged section 13 towards the connecting end 15, which in turn pushes the sleeve 14 towards the connector 1. The solder 18 also provides a securing function. When the connector 1 is plugged into any video signal output terminal, the metal core 21 transmits a pole (positive or negative) signal while the other pole (negative or positive) signal is transmitted through the sleeve 14 of the connector 1 to the metal layer 23.

I claim:

1. A coaxial connector structure comprising:

a signal wire, said signal wire including a metal core wrapped by an insulating layer, said insulating layer being wrapped with a metal layer overlayed a nonconducting cover;

a connector coupled to said signal wire, said connector having a threaded section at one end thereof and a longitudinally extended connecting section at an opposing end, said connecting section having a longitudinally directed opening extending from an enlarged section at a proximal end of said connecting section;

a metal sleeve disposed in said opening of said connecting section and having a tubular wall defining a through bore extending longitudinally therein and a pair of diametrically opposed holes formed through said tubular wall and being in open communication with said through bore, said signal wire being disposed in said through bore and said metal layer being coupled to said sleeve by solder filled in said holes, said metal core of said signal wire extending from a distal end of said sleeve and passing into said threaded section, said sleeve having a proximally disposed connecting end formed thereon with an outer diameter less than an outer diameter of a remaining portion of said sleeve, said enlarged section of said connecting section being crimpingly engaged with said connecting end of said sleeve and thereby applies a longitudinal bias force to said sleeve; and, an insulating washer disposed in said opening of said connecting section in contact with said distal end of said sleeve.

* * * * *